US007231889B2

(12) United States Patent
Coffin

(10) Patent No.: US 7,231,889 B2
(45) Date of Patent: Jun. 19, 2007

(54) SADDLE HAVING IMPROVED COMFORT AND CONTACT BETWEEN RIDER AND HORSE

(76) Inventor: Edmund S. Coffin, 1151 Dairy Rd., Ruckersville, VA (US) 22968

( * ) Notice: Subject to any disclaimer, the term of this patent is extended or adjusted under 35 U.S.C. 154(b) by 0 days.

(21) Appl. No.: 10/779,137

(22) Filed: Feb. 13, 2004

(65) Prior Publication Data

US 2004/0216433 A1 Nov. 4, 2004

Related U.S. Application Data

(60) Provisional application No. 60/447,837, filed on Feb. 13, 2003.

(51) Int. Cl.
*B68C 1/02* (2006.01)
*B68C 1/14* (2006.01)

(52) U.S. Cl. ..... 119/44.1; 54/46.1

(58) Field of Classification Search ..... 54/44.1, 54/44.3, 44.5, 44.7, 46.1
See application file for complete search history.

(56) References Cited

U.S. PATENT DOCUMENTS 3,096,552 A * 7/1963 Kreger, Jr. ..... 24/166
4,414,791 A * 11/1983 Freeze ..... 54/44.3
6,557,328 B1 * 5/2003 Stinnett et al. ..... 54/47

FOREIGN PATENT DOCUMENTS

EP 0 466 270 A1 * 1/1992

* cited by examiner

*Primary Examiner*—Robert P. Swiatek
(74) *Attorney, Agent, or Firm*—Sheldon H. Parker

(57) ABSTRACT

A sweat panel for a saddle is connected to the saddle by a flexible connection member along a portion of the width. The sweat panel perimeter replicates the under panel perimeter to enable the two to be separated by preferably less than one quarter inch. Billets are disclosed that notch the billet leather to receive a connecting strip to connect the billet leather to the tree webbing, thereby reducing the thickness of the billets.

24 Claims, 4 Drawing Sheets

SADDLE HAVING IMPROVED COMFORT AND CONTACT BETWEEN RIDER AND HORSE

CROSS-REFERENCE TO RELATED APPLICATIONS

This application claims priority from U.S. Provisional Patent Application No. 60/447,837 filed Feb. 13, 2003, entitled "Saddle Having Improved Comfort and Contact Between Rider and Horse. The entire contents and disclosures of the above application is hereby incorporated by reference.

BACKGROUND OF THE INVENTION

FIELD OF THE INVENTION

This invention relates to an improved saddle that dramatically reduces girth and rider related pressure along the under panels while increasing the rider's leg contact with the horse.

BRIEF DESCRIPTION OF THE DRAWINGS

The advantages of the instant disclosure will become more apparent when read with the specification and the drawings, wherein.

DETAILED DESCRIPTION OF THE INVENTION

Figure 1:
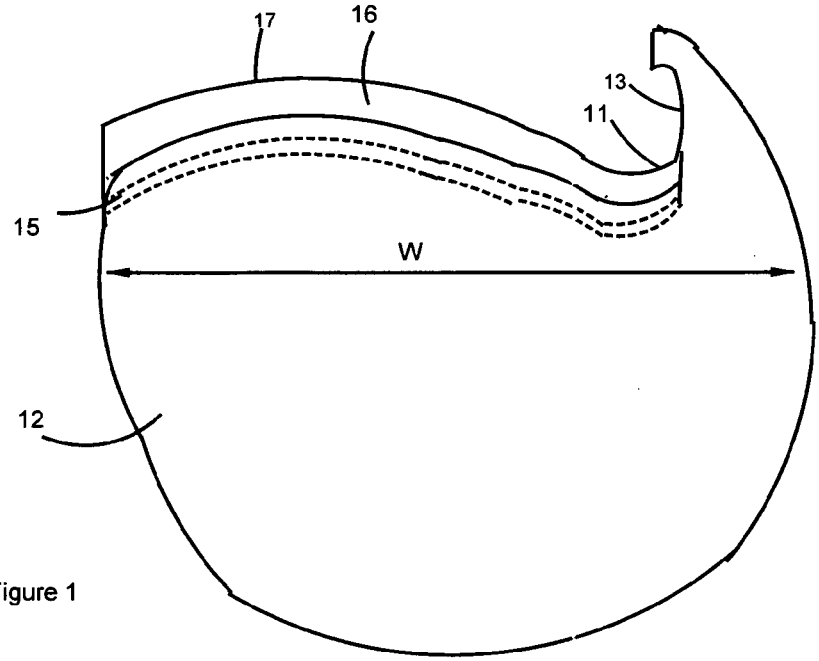
FIG. 1 is a front view of the disclosed sweat flap.

With a few exceptions, saddles have a pair of flaps extending on each side from the saddletree. The flap closest to the horse is the sweat flap and the flap closest to the rider will be referred to herein as the outer flap. The girth is attached to billets that are affixed to the saddletree and positioned between the sweat flap and the outer flap. In prior art saddles, the sweat flap is secured to the saddle in one of two ways. In the most common design, a separate piece of material is used to form the sweat flap, which is then secured along a portion of its upper width, over the panel, to the saddletree. Some manufacturers, however, have combined the sweat flap with the under panel, using a single length of material with stitching serving as the definition between the heavily padded under panel and the sweat flap. This is referred to in the industry as an integrated sweat flap. Since the billets and girth lie over the sweat flap, once the girth is tightened the sweat flap is pinned between the horse and the girth. In prior art saddles, however, the pressure is predominantly transmitted to the lower edge of the panel, thereby creating a pressure line along the horses back.

In saddles having a separately constructed sweat flap directly attached to the outer surface of the panel, the sweat flap is held away from the horse along the panel line, creating a down step from the outer surface of the panel to the horses body. This down step can maintain the sweat flap away from the horse side for about two to three inches along the back portion of the sweat flap, less right under the stirrup leathers. The result of the step down is that the panel serves as an end point for both the downward pressure and inward pressure from the riders leg. In addition to directing most of the downward and inward pressure to the panel line, this down step also prevents the riders leg from getting close to the horse.

To overcome the problems associated with prior art sweat flap designs, the disclosed sweat flap 12 is cut to match the arch of the under panel 14 over a substantial portion of its width W and is secured to the under panel 14 through use of a pliable material connector strip 16. By separating the sweat flap from the panel, the down step is removed and the underside of the sweat flap is able to lie on the same plane as the underside of the panel. This provides several advantages over the prior art separate sweat flap. First, the pressure is allowed to continue in a seamless fashion down through the sweat flap, the entire surface of which is now lying along the horse. Since the under surface of both the panel and sweat flap are along the same plane, there is no defining line for pressure. This also increases the surface area of the sweat flap that contacts with the horse, permitting the vertical and inward pressure to be distributed over a greater area. Additionally, without the step down the rider is able to place their leg closer to the horse, thereby creating optimal contact.

In integrated panel designs the issue of a gap between panel and sweat flap is eliminated. However, in the integrated panel, when the girth is tightened, pulling down on the sweat flap, the panel is also pulled down and into the horse's back.

Due to the separation of the sweat flap 12 from the panel 14, in the disclosed saddle, when the girth is tightened the vertical downward and inward pressure pulls on the pliable connection strip and does not transfer pressure to panel.

Figure 2:
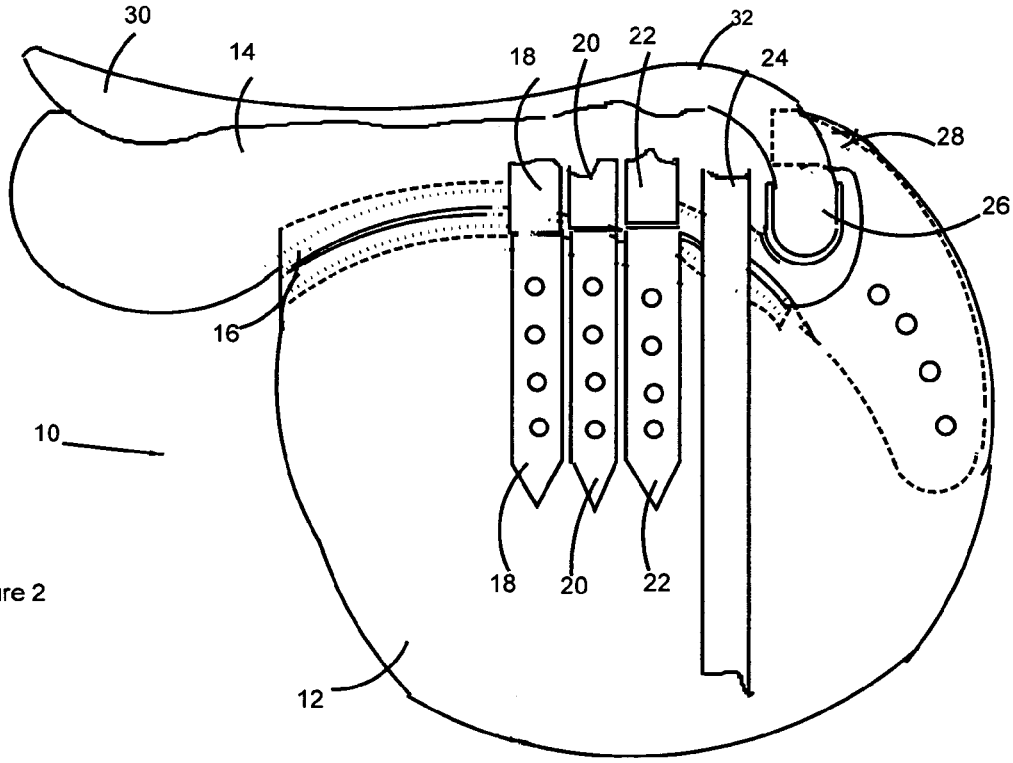
FIG. 2 is a front view of the disclosed sweat flap attached to the under panel.

As can be seen in FIGS. 1 and 2, the sweat flap 12 follows the perimeter of the under panel 14, from the cantle 30 area toward the pommel 32, until the descending arch 17 is past the line of the stirrup leather 24. It is critical for optimal performance that the curve of the sweat flap 12 follow the curve of the panel 14 as closely as possible since once gaps are created between the two edges, the continuum created will be reduced. The cut between the sweat flap 12 and the panel 16 must extend beyond the stirrup leather 24 in order to spread the tremendous pressure that is exerted on the panel 14 in that region. If the sweat flap 12 starts the first ascending arc 11 prior to, or at, the stirrup leather 24, the continuum created by the under surface of the sweat flap 12 being on the same plane as the under surface of the panel 14 is broken, pulling the panel 14 into the horses back. The cut continues to about the midpoint of the tree points 26, including the first ascending arc 11 at which point the sweat flap 12 arches upward in an a second ascending arc 13, at which point the sweat flap 12 is no longer connected to the connector strip 16. The second ascending arc 13 continues to the end 28 of the sweat flap 12 where it is secured to the tree 30 proximate the pommel 32. Once the sweat flap 12 starts the second ascending arc 13, it is placed over the panel 14 and secured as known in the art. This enables the perimeter of the sweat flap 12, from the edge nearest the cantle to just past the stirrup leather 24, the areas under the greatest inward pressure from the girth and stirrup leathers, to move independently from the under panel 14. At the point where the sweat flap 12 arcs upward in the second arc 13, and is subsequently secured to the tree 30, there is little downward vertical pressure applied.

The connector strip 16 is secured along the under side, closest to the horse, along one side of its length to the contoured sweat flap 12 through stitching, as seen herein with stitch lines 15, or through any other applicable method that will not cause discomfort to either the horse or rider. The sweat flap is then placed adjacent to the panel 14 and the connector strip 16 is secured to the exterior side, furthest from the horse, of the panel 14. The order in which the connector strip 16 is secured is not critical, however the alignment of the perimeter of the sweat flap 12 with the perimeter of the panel 14 is crucial. Since there is a substantial thickness to the under panel 14, the leather strip 16 can be secured to the under panel 14 in any applicable manner, such as stitching, rivets, glue, or other methods know in the art. Alternatively, the connector strip 16 can be attached directly to the saddletree with the width of the connector strip being increased appropriately. The connector strip 16 can be manufactured of any suitable material, such as leather or various synthetics, as long as the material meets the criteria set forth herein.

The billet straps 18, 20 and 22 are connected to the tree 30 in any of the methods known in the saddle art. A girth is secured to the billets on each side of the saddle and tightened to maintain the saddle in place on the horse's back. This presses the sweat flap 12 toward the horse's sides and, in prior art saddles, also causes the under panel 14 to apply pressure to the back. As can be seen in FIG. 2, although the downward pressure of the billets 18, 20 and 22 is located over the floating sweat flap 12, due to the flexible connection between the under panel 14 and the floating sweat flap 12, this pressure is eliminated at the sweat flap 12/under panel 14 juncture as well as along the periphery of the under panel 14. Rather than pressing into the horse's back, the pressure is distributed over the entire surface of the sweat flap 12.

To provide the desired results, the connector strip 16 must be flexible with a slight amount of give. Since leather, based on tradition, will be the most commonly used material, the following will refer to flexible leather, however the criteria is applicable to any material and the dimension adjustments will be known to those skilled in the art. The leather should have a thickness of about 1 mm–2 mm to provide strength without rigidity. Although direct downward weight is not applied to the sweat flap 12, as it is to a stirrup leather or billet, the strength of the material must be sufficient to prevent tearing or separation from either the under panel 14 or the sweat flap 12 at the points of contact. For strength reasons, the connector strip should lap the panel 14 and the sweat flap 12 by at least one quarter inch, and preferably one inch, to permit ease of stitching. The overlap distance and stitching materials and style will be evident to those skilled in the art. As stated heretofore, the curvature of the sweat flap 12 should be as close to the curvature of the panel 14 as possible to maintain the sweat flap 12 on the same plane as the under surface of the panel 14. A distance between the sweat flap 12 and the under panel 14 of greater than about ¼ inch starts to lose the effectiveness achieved in the disclosed invention.

Figure 8:
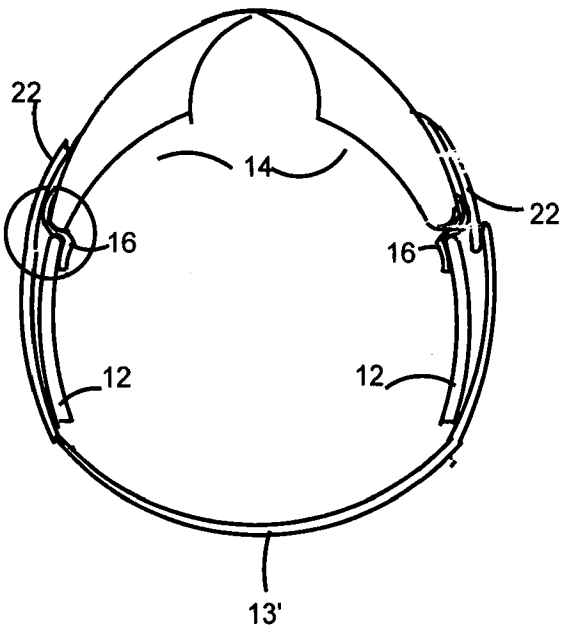
FIG. 8 is a rear view of FIG. 7 with a girth tightened.
Figure 7:
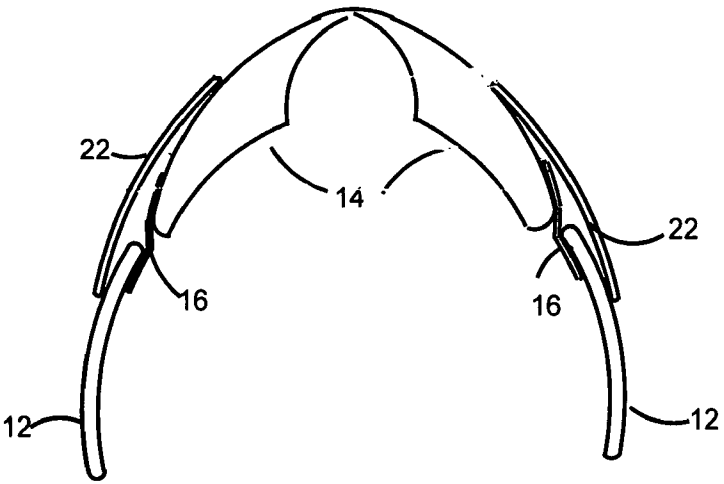
FIG. 7 is a rear view of the disclosed saddle without being tightened with a girth.

In FIGS. 7 and 8 the mechanics of the connecting strip 16 are illustrated. In FIG. 7 the saddle is illustrated from the back view as it would normally rest on the horse's back prior to adding a girth 13'. The billets 22 are loose and resting on the sweat flaps 12. In FIG. 8, the girth 13' has been placed on the billets 22 and tightened. As can be seen, the sweat flaps 12 press toward the horse's body, causing the connecting strip 16 to flex and move toward the horse's body. The under panels 22, however, do not move inward as the girth 13' is tightened, thereby preventing pinching of the horse's back. The disclosed sweat flap does not, in any way, hamper securing the saddle to prevent sliding. Rather the fact that the sweat flaps are laying on the same plane as the panel, creating an evenness of pressure, makes the disclosed saddler less likely to slide.

Figure 3:
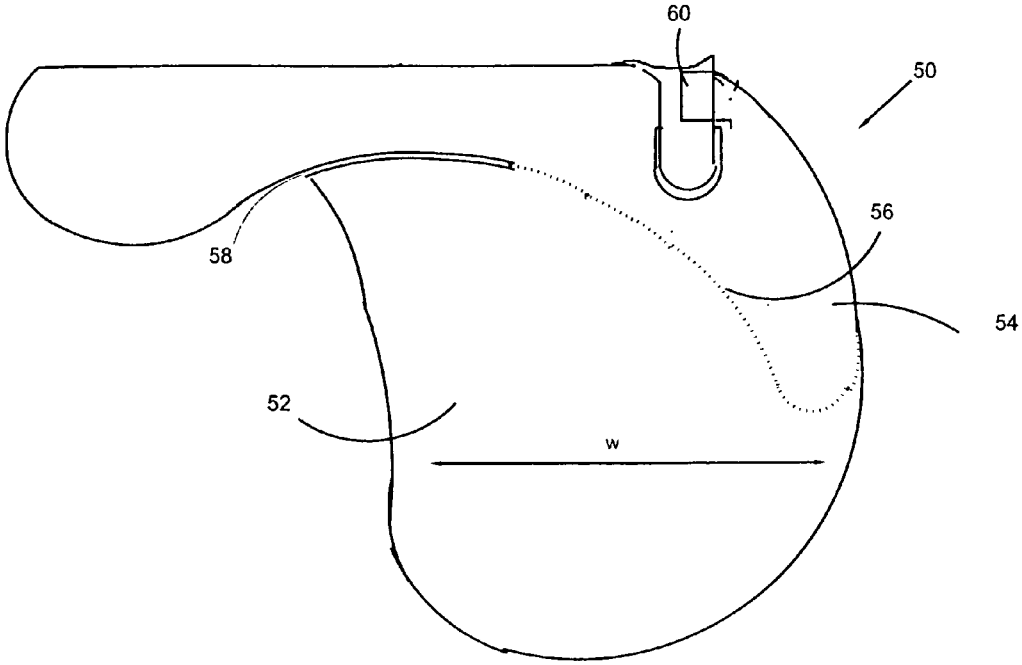
FIG. 3 is a front view of an alternate embodiment illustrating the disclosed improvement on a combination panel/sweat flap.

In an alternate embodiment illustrated in FIG. 3, the integrated panel of the saddle 50 uses the same leather, or other covering, to cover the under panel 54 as it does to form the sweat flap 52. The stitching 56 forms the definition between the panel 54 and flap 52, as well as retains the under panel stuffing in place. In order to create the floating sweat flap 52, a separation cut 58 is placed in the leather of the panel 52 where the stitching 56 would normally form the definition. Due to a stability issue, in this embodiment the separation cut 58 cannot extend to a point after the stirrup leather, as is taught heretofore. For a 16–17 inch adult saddle, the separation cut 58 would be on the order of about four to five inches. The length will vary depending upon the size of the saddle and will be evident to those skilled in the art.

Figure 6:
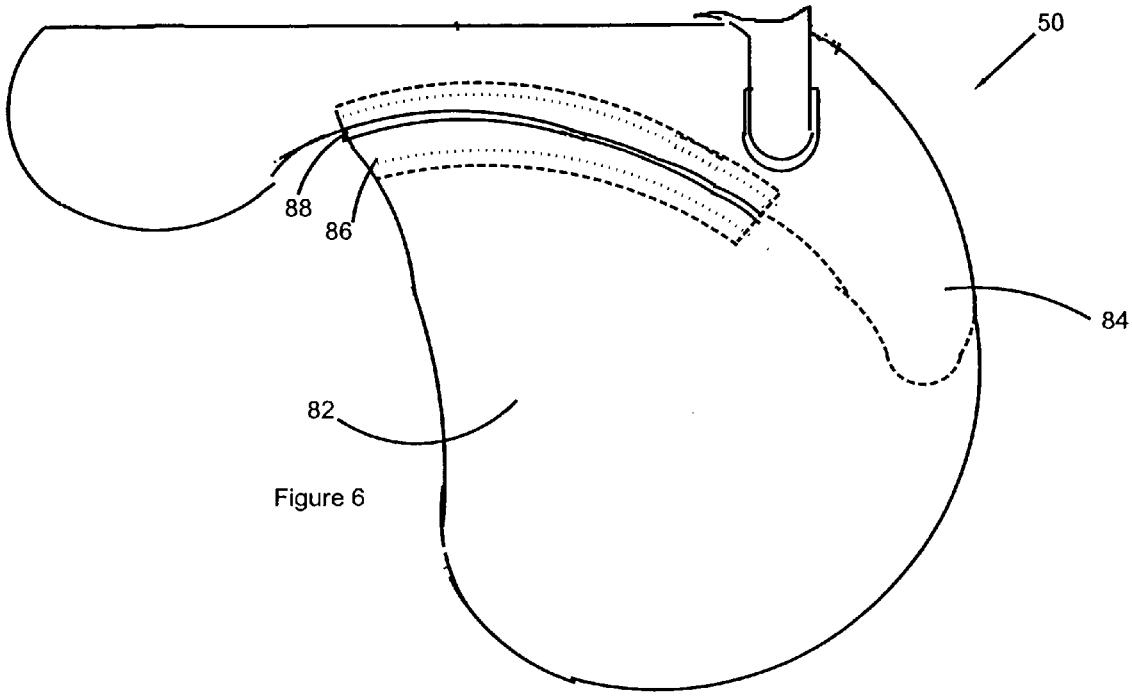
FIG. 6 is a front view of an additional embodiment of the combination panel/sweat flap.

As an alternative to the embodiment of FIG. 3, and as illustrated in FIG. 6, a flexible support strip 86 is used to flexibly connect the split portion of the integrated sweat flap 82 to the under panel 84. When the flexible support strip 86 is used, producing the results as described heretofore, the slit 88 can be extended to past the stirrup leather line producing the equivalent to the embodiment illustrated in FIG. 2.

Figure 4:
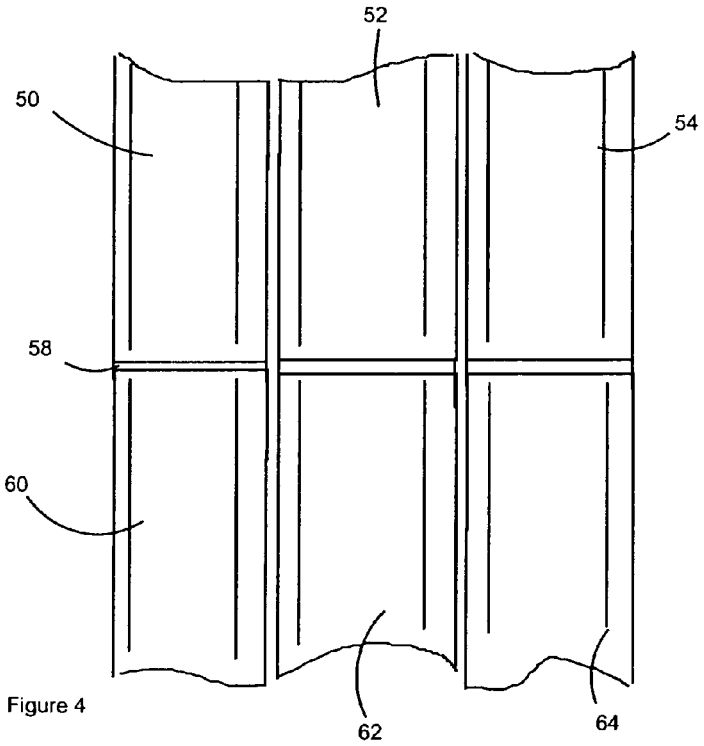
FIG. 4 is a front view of the billets of the disclosed invention.
Figure 5:
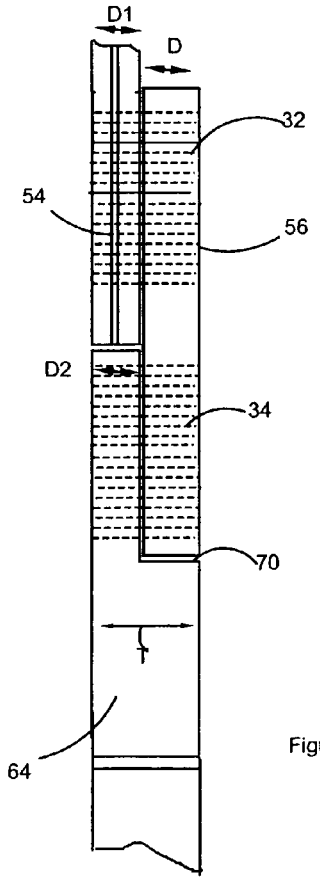
FIG. 5 is a side view of the billets of FIG. 4.

In order to reduce the distance between the rider's legs and the horse, the preferred billets for use with the disclosed sweat flap design are notched and connected to the billet webbing through the use of a rear connector. It should be noted that although when used together the floating sweat flap and split billets provide optimum performance, either element can be used independently. This design is illustrated in FIGS. 4 and 5 wherein the billet webbings 50, 52 and 54 are connected directly to the tree (not shown) and extend only a portion of the total billet length. As seen in the side view of FIG. 5, the billet webbing 50 is backed by a rear connector 56 that serves to connect the billet strap 64 to the billet webbing 54. Depending upon the material of manufacture of the billet webbing 50, 52 and 54 can be double thickness for additional strength and thickness. This will not be necessary when using some materials and whether or not the material needs to be doubled will be evident to those skilled in the art. The billet webbing 50, 52 and 54 and rear connector 56, (66 and 68 not shown) as an alternative to leather, can be manufactured from a web or other equivalent material having minimal stretch. As shown in FIG. 5, the billets 60, 62 and 64 are notched 70 along the thickness "T" an amount equal to the depth D of the rear connector 56. The billet webbing 54 is stitched to the rear connector 56 at stitch lines 32 while the lower billet 64 is stitched to the rear connector 56 through stitch lines 34. The depth D1 of the billet webbing 54 should be about equal to the depth D2 of the full length portion of the billet 64. To maintain the smoothness desired, the combined thickness of the billet webbing 54 and the rear connector 56 should be about equal to the thickness "T" of the un-notched portion of the billet 64. It should be noted that although reference is made above to the billet 60 illustrated in FIG. 5, the design description relates to all billet 60, 62 and 64.

The billet design as disclosed herein has the billet webbings 50, 52 and 54 independently affixed to the tree as well as independent of one another. This is unlike prior art billets where the two billets closest to the cantle are joined for a portion of their length. It should be noted, however, that the split design taught herein can be used with the prior art billet design.

What is claimed is:

1. An equine saddle having a first surface and a second surface, a cantle, a pommel, a tree and an under panel proximate to said second surface, said saddle having:

a sweat flap, said sweat flap having a first periphery, said first periphery having a first section, a second section, and a width, a portion of said second section being secured directly to said tree proximate said pommel, a connector strip, said connector strip having a length equal to at least a substantial portion of said width of said sweat flap, a first side of said length of said connector strip being affixed to said first section and a second side of said length of said connector strip being affixed to said saddle to maintain said first section of said sweat flap adjacent to and spaced from said under panel.

2. The equine saddle of claim 1 wherein said first section of said first periphery substantially parallels a periphery of said under panel.

3. The equine saddle of claim 1 wherein said first section has a descending arc and an ascending arc.

4. The equine saddle of claim 3 wherein said descending arc extends toward said pommel and stirrup leathers and said ascending arc starts after said stirrup leathers.

5. The equine saddle of claim 3 wherein said descending arc is proximate said cantle and said ascending arc is proximate said pommel.

6. The equine saddle of claim 1 wherein said second section of said first periphery is the end of an ascending arc.

7. The equine saddle of claim 1 wherein said sweat flap is spaced from said under panel less than one quarter of an inch.

8. The equine saddle of claim 1 wherein said first side of said connector strip is connected to an interior side of said sweat flap and second side of said connector strip is connected to an exterior side of said panel.

9. The equine saddle of claim 1 further comprising at least one billet, each of said at least one billet having a billet webbing member having a length and a depth, a rear connection member having a length and a depth and a billet strap having a length and a depth, wherein a first end of said billet strap width has a notched portion and an un-notched portion, said notched portion having a depth equal to said depth of said rear connection member, and said rear connection member is secured to said billet strap and said billet webbing member to said billet strap first end to said billet webbing member.

10. The equine saddle of claim 9 wherein said billet webbing member has a depth equal to said un-notched portion of said first end of said billet strap.

11. The equine saddle of claim 10 wherein each of said at least one billet is independently affixed to said saddle.

12. The equine saddle of claim 1 wherein said second side of said length of said connector strip is affixed to said under panel.

13. The equine saddle of claim 1 wherein said second side of said length of said connector strip is affixed to said tree.

14. An equine saddle having a first surface and a second surface, a cantle, a pommel, and an integrated panel, a first portion of said integrated panel covering an under panel and a second portion of said integrated panel forming a sweat flap having a periphery; a first section of said integrated panel being secured along a first line from a base point to said sweat flap periphery adjacent to said under panel and a second line from said base point to said sweat flap periphery being cut to space said sweat flap from said under panel.

15. The equine saddle of claim 14 wherein said first section of said integrated panel is secured along said first line by stitching.

16. The equine saddle of claim 15 wherein said first section of said integrated panel is proximate said pommel.

17. The equine saddle of claim 14 further comprising at least one billet, each of said at least one billet having a billet webbing member having a length and a width, a rear connection member having a length and a width and a billet strap having a length and a width, wherein a first end of said billet strap width has a notched portion and an un-notched portion, said notched portion having a depth equal to said depth of said rear connection member, and said rear connection member is secured to said billet strap and said billet webbing member to connect said billet strap first end to said billet webbing member.

18. The equine saddle of claim 17 wherein said billet webbing member has a depth equal to the un-notched portion of said first end.

19. An equine saddle having at least one billet, each of said at least one billet having:

a billet strap, said billet strap having a notched portion and an un-notched portion;

a billet webbing member, said billet webbing member having a depth about equal to said un-notched portion of said billet strap;

a rear connection member, said rear connection member having a depth about equal to the depth of said notched portion to connect said billet strap to said billet webbing member.

20. The equine saddle of claim 19 wherein said notched portion and said un-notched portion have about equal depths.

21. The equine saddle of claim 19 wherein each of said at least one billet is independently affixed to said saddle.

22. A method of eliminating pressure on a horse's back created by an under panel along the perimeter of a saddle, comprising the steps of:

configuring a sweat flap to have a first portion of a periphery substantially replicating a perimeter of said under panel and a second portion of said periphery to attach to said saddle;

permanently securing a first side of a flexible connector strip to a said first portion of said periphery of said sweat flap;

positioning said sweat flap adjacent to and spaced from said under panel;

permanently securing a second side of said flexible connector strip to said saddle;

permanently securing said second portion of said periphery to said saddle;

wherein said flexible connector strip prevents pressure from a tightened girth and a rider's weight placed on stirrups from transferring to said perimeter of said under panel.

23. An equine saddle having a first surface and a second surface, a cantle, a pommel, a saddletree and an under panel proximate to said second surface, said saddle having:

a sweat flap, said sweat flap having a first periphery, said first periphery substantially replicating a periphery of said under panel, and having a first section having a descending arc extending toward said pommel and stirrup leathers and an ascending arc, said ascending arc starting after said stirrup leathers, and a second section, said second section having a second ascending arc;

a second periphery and a width, said second section of said first periphery being affixed to said saddletree, a connector strip, said connector strip having a length equal to at least a substantial portion of said width of said sweat flap, a first side of said length of said connector strap being affixed to said first section of said first periphery and a second side of said length of said connector strap being affixed to said saddle to maintain said sweat flap adjacent to and spaced from said under panel.

24. The equine saddle of claim 23 further comprising at least one billet, each of said at least one billet having a billet webbing member having a length and a depth, a rear connection member having a length and a depth and a billet strap having a length and a depth, wherein a first end of said billet strap depth has a notched portion and an un-notched portion, said notched portion has a depth equal to said depth of said rear connection member, and said billet webbing member has a depth equal to said un-notched portion of said first end, said rear connector connecting said billet strap first end to said billet webbing member.

* * * * *